US005144366A

United States Patent [19]

Sakamoto et al.

[11] Patent Number: 5,144,366

[45] Date of Patent: Sep. 1, 1992

[54] COOLING SYSTEM FOR USE IN AN IMAGE FORMING MACHINE

[75] Inventors: Hiroyuki Sakamoto; Naruyuki Miyamoto; Ichirou Takahashi; Takashi Nagashima; Hiroyuki Arai, all of Osaka, Japan

[73] Assignee: Mita Industrial Co. Ltd., Osaka, Japan

[21] Appl. No.: 784,941

[22] Filed: Oct. 31, 1991

[30] Foreign Application Priority Data

Oct. 31, 1990 [JP] Japan ..... 2-294068

[51] Int. Cl.[5] ..... G03G 21/00

[52] U.S. Cl. ..... 355/208; 355/30; 361/384

[58] Field of Search ..... 355/200, 203, 204, 208, 355/210, 30; 174/15.1; 361/381, 383, 384

[56] References Cited

U.S. PATENT DOCUMENTS 4,093,368 6/1978 Nishikawa ..... 355/210
4,727,385 2/1988 Nishikawa et al. ..... 355/30 X
5,073,796 12/1991 Suzuki et al. ..... 355/30 X
5,095,333 3/1992 Shimada ..... 355/208

FOREIGN PATENT DOCUMENTS 0271482 11/1988 Japan ..... 355/30
0059251 3/1989 Japan ..... 355/30

*Primary Examiner*—A. T. Grimley
*Assistant Examiner*—Sandra L. Brasé
*Attorney, Agent, or Firm*—Cushman, Darby & Cushman

[57] ABSTRACT

A cooling system for an image forming machine which is provided with a single temperature sensor for detecting a temperature inside the image forming machine, an operating section for setting the number of sheets to be copied continuously, a judgment circuit for determining a voltage value applied to a cooling fan in accordance with the set number of sheets and the temperature detected by the temperature sensor, and a drive control circuit for controlling the voltage applied to the cooling fan in accordance with the voltage value determined by the judgment circuit and drive the cooling fan.

7 Claims, 4 Drawing Sheets

COOLING SYSTEM FOR USE IN AN IMAGE FORMING MACHINE

BACKGROUND OF THE INVENTION

1. Field of the Invention

The present invention relates generally to a cooling system for an image forming machine and more particularly to a cooling system in which temperature inside an image forming machine is detected by a temperature sensor and the inside of the image forming machine is controlled not to exceed a predetermined temperature value by using a cooling fan.

2. Related Art

The conventional cooling system for an image forming machine shown in FIG. 1 is provided in a body 11 of the machine having an original sheet plate 12, a photo-sensitive drum 13, a printed substrate 14 on which a control circuit is provided, and a printed substrate 15 on which a drive circuit is provided for driving various motors, each mounting thereon a temperature sensor *22a*, *22b*, *22c* and *22d*, respectively. Each temperature sensors *22a*, *22b*, *22c* and *22d* is connected to a read-and-judgement circuit 16 as shown in FIG. 2, which reads each temperatures and judges if a cooling fan 18 is to be actuated through a drive control circuit 24 so that an excessive increase of the temperature inside the image forming machine is appropriately suppressed. The rotational speed of the fan 18 is selected from "HIGH", "MIDDLE" and "LOW" levels. Therefore, an operation and function of each mechanical parts of the image forming machine is not influenced by an excessive heat but stably and appropriately maintained.

However, the conventional cooling system thus constructed requires many temperature sensors be installed inside the image forming machine that would cause the machine be complicated in structure and increase the manufacturing cost. Thus the conventional cooling system is disadvantageous mechanically and economically. Further, since each of the temperature sensors *22a*, *22b*, *22c* and *22d* is controlled independently, it would be difficult to obtain an appropriate cooling operation due to an intricate control.

SUMMARY OF THE INVENTION

The present invention was made in order to overcome the above-described difficulties accompanying the conventional cooling system.

An object of the present invention is to provide a cooling system for an image forming machine requiring only one temperature sensor thereby reducing a manufacturing cost.

Another object of the present invention is to provide a cooling system for an image forming machine capable of obtaining an appropriate cooling operation with simple structure and control.

The above and other objects can be achieved by a provision of a cooling system for an image forming machine which, according to the invention, is provided with a single temperature sensor for detecting a temperature inside the image forming machine, an operating section for setting the number of sheets to be copied continuously, a judgment circuit for determining a voltage value applied to a cooling fan in accordance with the set number of sheets input through the operating section and the temperature value detected by the temperature sensor, and a drive control circuit for driving the cooling fan in accordance with the voltage value determined by the judgment circuit, so that the inside of the image forming machine is appropriately cooled by the cooling fan.

When the number of sheets to be copied is set by an operator through the operating section, the judgment circuit determines a voltage value in accordance with a signal representing the number of sheets to be copied set from the operating section and a signal representing the temperature generated by the temperature sensor, and then the selected voltage value is applied to the drive control circuit which drives a motor for rotating the cooling fan.

DESCRIPTION OF THE PREFERRED EMBODIMENT

The preferred embodiment of the present invention will now be described in detail with reference to accompanying drawings.

Figure 1:
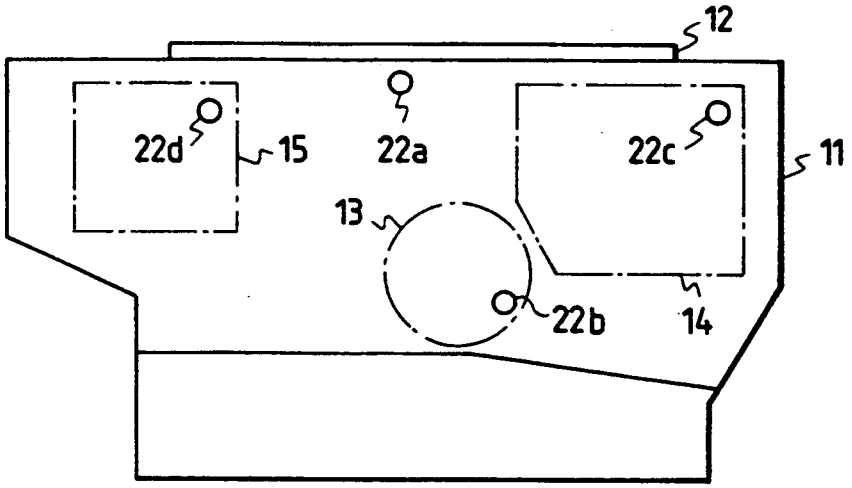
FIG. 1 PRIOR ART
FIG. 1 is a schematic view of a conventional cooling system for an image forming machine.
Figure 2:
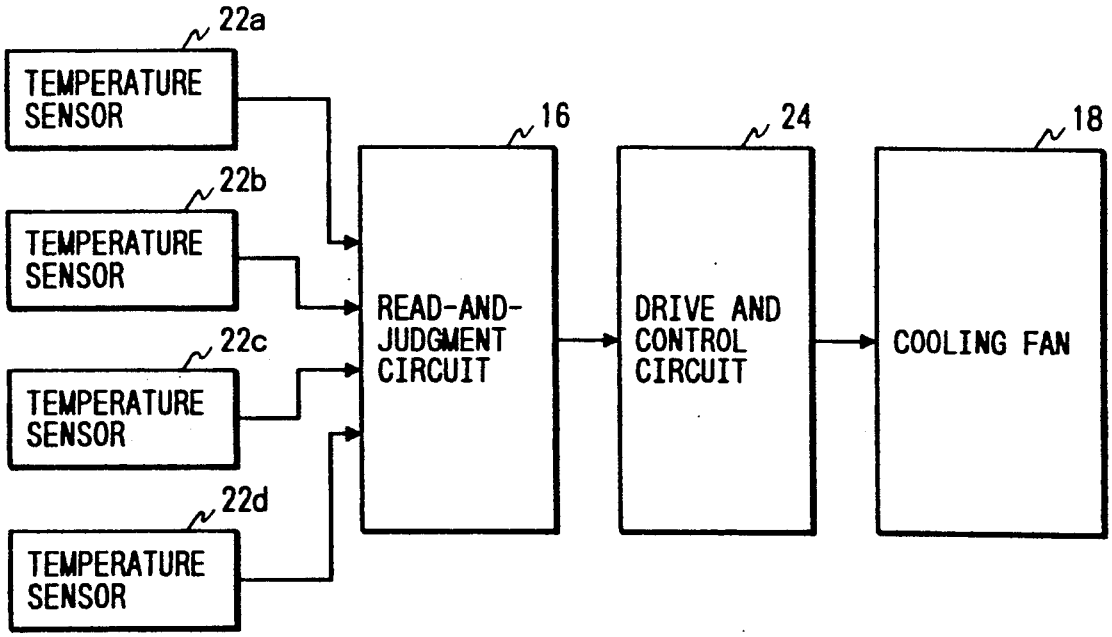
FIG. 2 PRIOR ART
FIG. 2 is a block diagram showing an operational flow of the conventional cooling system.
Figure 3:
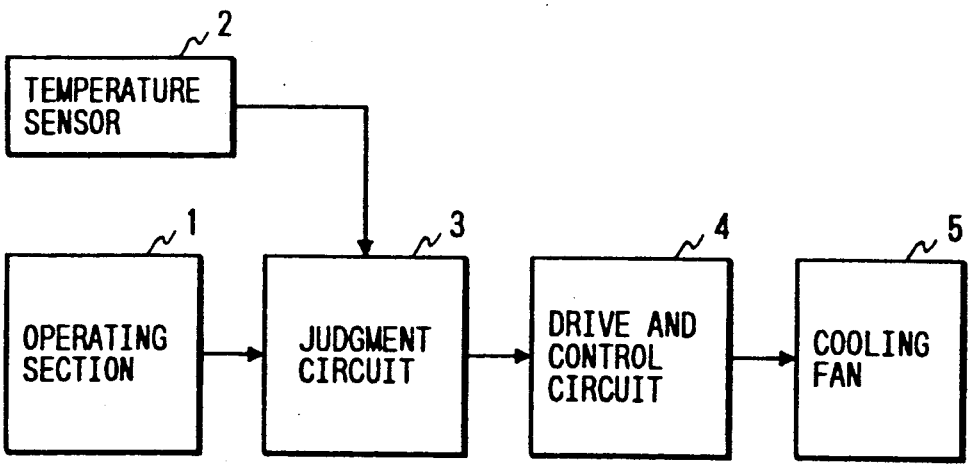
FIG. 3 is a block diagram showing an operational flow of the cooling system according to the present invention.
Figure 9:
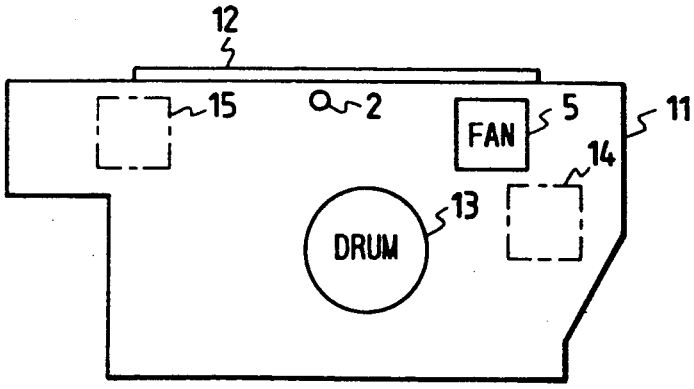
FIG. 9 is a schematic view of an image forming machine having a single temperature sensor.

FIG. 3 is a block diagram showing an operational flow of the cooling system embodying the invention. An operator sets a required number of sheets to be copied continuously or the like from an operating section 1. A temperature sensor 2 is located at a predetermined position inside the image forming machine, for example, at a position close to an optical system where the temperature is relatively high as shown in FIG. 9. According to the invention, only one temperature sensor 2 is necessary.

Both a signal representing the number of sheets to be copied continuously set from the operating section 1 and a signal representing a temperature detected by the temperature sensor 2 are supplied to a judgment circuit 3 where an appropriate voltage value for a cooling fan 5 is determined in accordance with these signals. The voltage determined in the judgment circuit 3 is supplied to the cooling fan 5 through a drive control circuit 4 so that the heat generated inside the image forming machine is cooled off by the rotation of the cooling fan 5.

Figure 4:
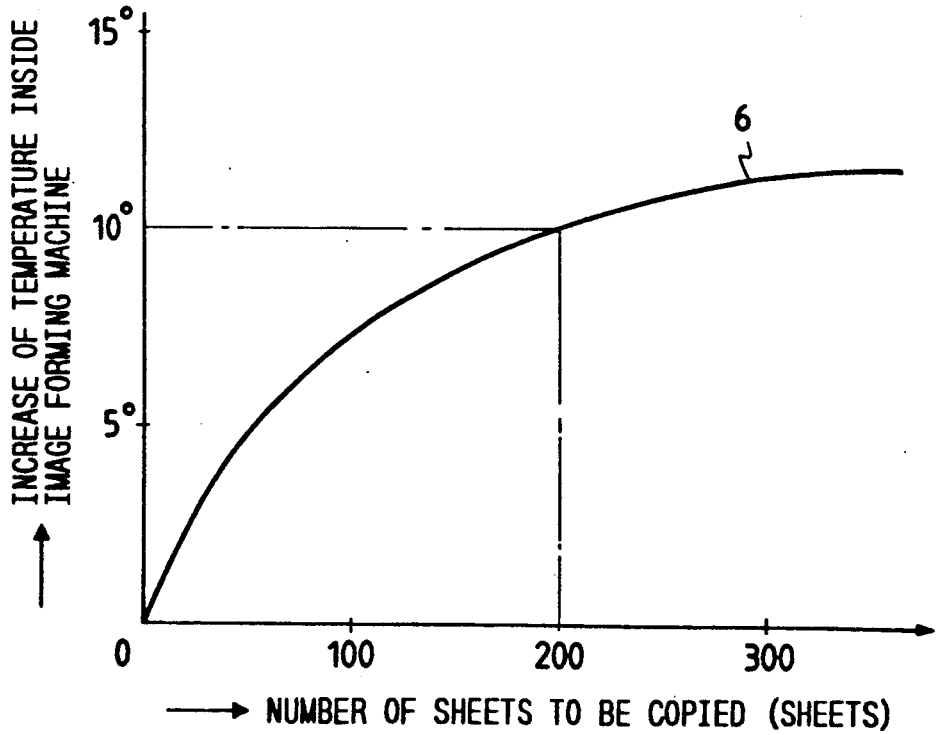
FIG. 4 is a graph showing a relationship between the numbers of the sheets to be copied continuously and the increase of the temperature inside the image forming machine according to the invention.

FIG. 4 is a graph showing a relationship between the numbers of the sheets copied continuously and the increase of the temperature inside the image forming machine. In the graph of FIG. 4, an abscissa indicates the number of sheets copied continuously and an ordinate indicates the increase of the temperature inside the image forming machine. As is apparent from a temperature variation curve 6 shown in FIG. 4, the increasing rate of the temperature inside the machine becomes calm when the number of copied sheets increases up to a certain extent. That is, even if the number of sheets which are copied continuously exceeds the certain extent, the temperature inside the machine does not increase correspondingly.

Further, as is apparent in FIG. 4, if the number of sheets copied continuously is 200, the temperature inside the machine increases to 10° C. In view of this fact, the invention was made considering that only one temperature sensor is necessary if the rotational speed of the cooling fan is controlled corresponding to the number of sheets to be copied continuously. Such an apparatus is much advantageous in that an appropriate and effective cooling operation can be achieved with a simple control and structure.

Figure 5:
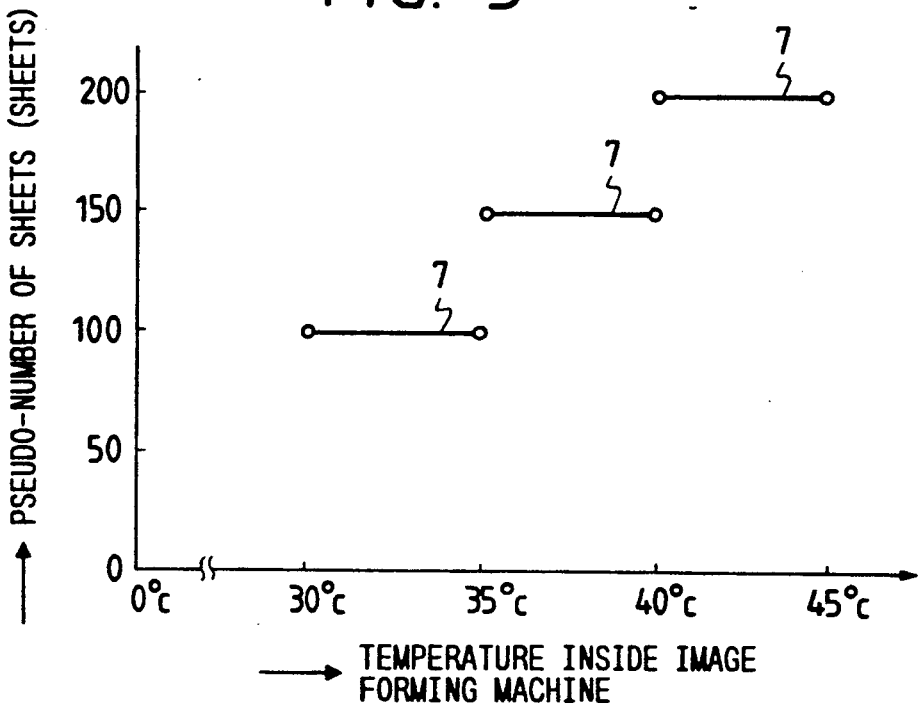
FIG. 5 is a graph showing a relationship between a temperature inside the image forming machine and a pseudo-number of sheets.

FIG. 5 is a graph showing a relationship between a temperature inside the image forming machine indicated on an abscissa thereof and a pseudo-number of sheets indicated on an ordinate thereof. The pseudo-number of sheets is an equivalent number of sheets which, in other words, is an assumed number determined corresponding to the temperature inside the image forming machine before starting the copying operation. For example, if the temperature inside the machine is within a range between 35° C. and 40° C., the pseudo-number of sheets is determined as 150. The judgment circuit 3 assumes that 150 sheets have been copied continuously if the detected temperature is within the range between 35° C. and 40° C. Lines 7 shown in FIG. 5 indicate the pseudo-members of sheets (equivalent number of sheets) derived from the temperature inside the image forming machine detected by the single temperature sensor 2.

Figure 6:
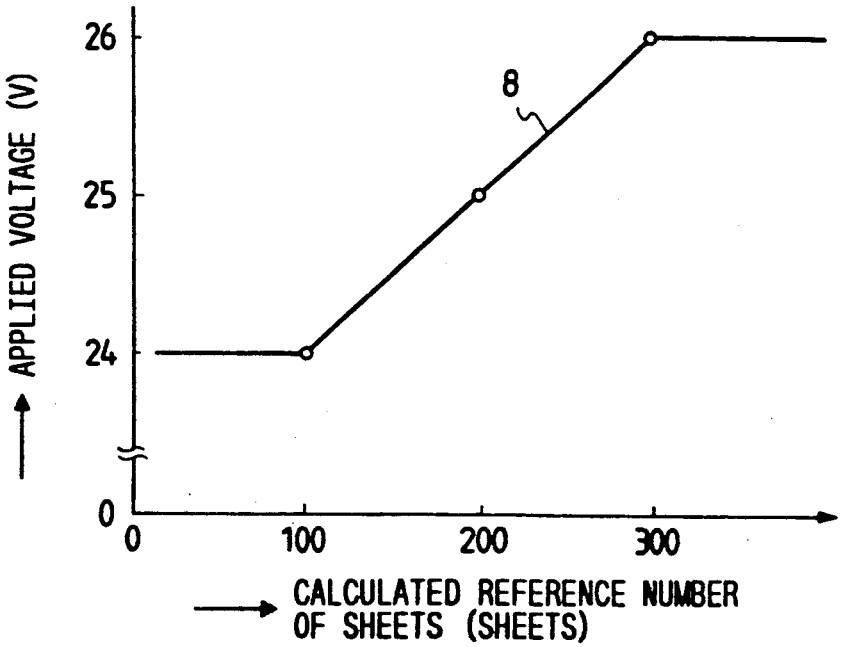
FIG. 6 is a graph showing a relationship between a calculated reference number of sheets and a voltage applied to a cooling fan according to the present invention.

FIG. 6 is a graph showing a relationship between a calculated reference number of sheets and a voltage applied to the cooling fan 5. The calculated reference number of sheets indicated on an abscissa of the graph is a sum of the required number of sheets to be copied continuously and the pseudo-number of sheets corresponding to the actual temperature detected by the sensor 2. In other words, the calculated reference number of sheets is a value derived by adding the actually required number of sheets to be copied continuously to the equivalent pseudo-number of sheets which is derived from and corresponding to the temperature inside the image forming machine as an initial value. The initial value varies in accordance with the environmental temperature of the image forming machine. That is, the initial value is set high if the room temperature is higher than average value because of, for example, heating system for the room or during summer.

As seen from the voltage valuable curve 8 in FIG. 6, the voltage value applied to the cooling fan increases in proportion as the increase of the calculated reference number of sheets within a certain range but maintains constant outside the certain range. That is, the voltage value is maintained at a constant value 24 volts until the reference number of sheets reaches 100, increases from 24 to 26 volts proportionally within the range between 100 to 300 reference number of sheets, and maintained again at substantially a constant value 26 volt beyond 300 reference number of sheets. For example, if the calculated reference number of sheet is 200, 25 volts power is applied to the cooling fan 5 according to the graph of FIG. 6. These calculation and judgement of the voltage is automatically processed in the judgment circuit 3.

Figure 7:
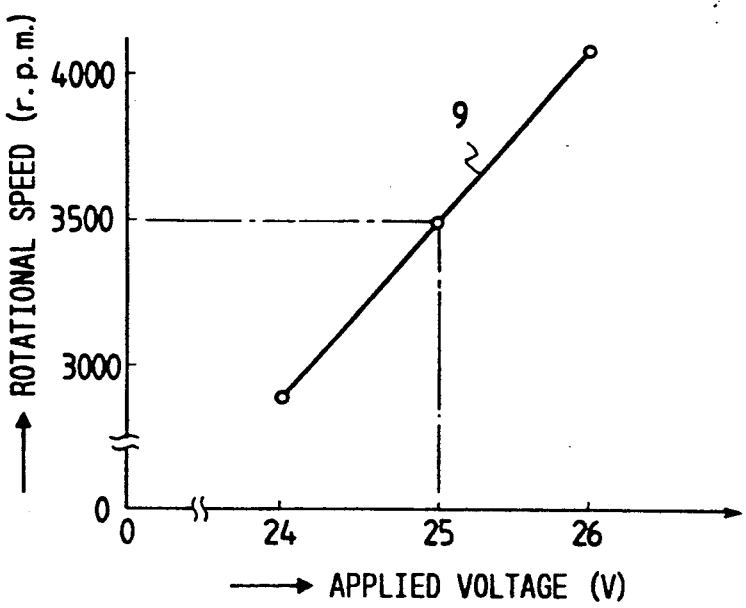
FIG. 7 is a graph showing a relationship between the voltage derived in accordance with the graph shown in FIG. 6 and a rotational speed of the cooling fan according to the invention.

FIG. 7 is a graph showing a relationship between the voltage applied to the cooling fan 5 in accordance with the graph shown in FIG. 6 and a rotational speed of the fan according to the embodiment of the invention. As is apparent from the graph in FIG. 7, the rotational speed of the cooling fan 5 increases proportionally from approximately 3,000 r.p.m. to 4,000 rpm within the range between 24 to 26 volts of the voltage applied to the cooling fan 5. Accordingly, it can be considered that the cooling efficiency increases in proportion to the increase of the voltage applied to the cooling fan. It is known from the rotational speed valuable line 9 in FIG. 7, if the voltage is 25 volt, for example, the rotational speed of the cooling fan 5 is 3,500 r.p.m.

Figure 8:
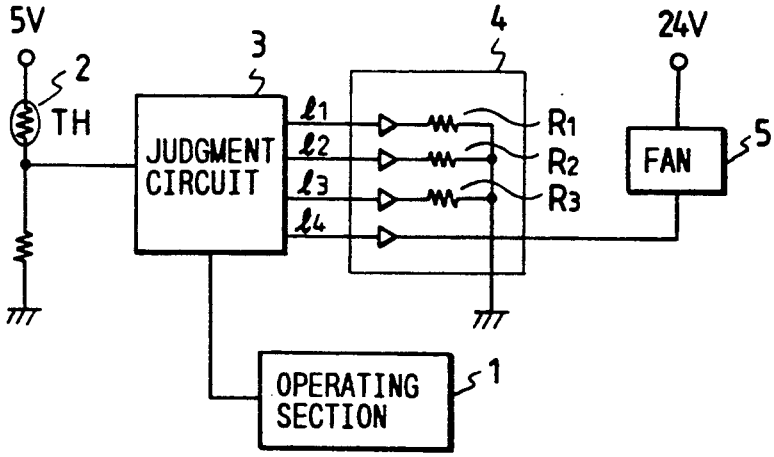
FIG. 8 is a circuit diagram showing the cooling system of the invention.

FIG. 8 is a circuit diagram showing the cooling system embodying the invention. As shown in FIG. 8, the drive and control circuit 4 includes three resistors $R_1$, $R_2$ and $R_3$ arranged in parallel with each other on lines $l_1$, $l_2$ and $l_3$, respectively. An each of resistant value of the resistors $R_1$, $R_2$ and $R_3$ is different from each other. The judgment circuit 3 selects a line from the lines $l_1$, $l_2$, $l_3$ and $l_4$ according to the calculated reference number of sheets to thereby changing the rotational speed of the cooling fan 5. No resistor is provided on the line $l_4$. Therefore, if the judgment circuit 3 outputs a signal representing 24 voltage value, 24 volt power is applied to the fan 5 because of no resistor. The temperature sensor 5 may be a thermistor, for example.

Although three resistors are employed in the embodiment of the invention described above. However, it is not limited thereto or thereby. That is, more than three resistors may be employed to control the cooling fan 5 more finely.

As described above, the present invention is based upon the fact that the temperature inside the image forming machine increases corresponding to the number of sheets to be copied continuously if the number of sheets is large. When an operator inputs his required number of sheets to be copied continuously, the judgment circuit calculates the reference number of sheets by adding the actually input number of sheets to the initial value derived in accordance with the temperature inside the machine detected by the single temperature sensor, and the judgment circuit determines the voltage value applied to the fan motor for driving the cooling fan, so that the machine is appropriately cooled.

That is, the cooling operation is achieved only by inputting the required number of sheets to be copied continuously with a single sensor. Thus, the effective cooling operation can be achieved with a simple structure and control.

The cooling system for the image forming machine according to the invention is provided with a single temperature sensor, an operating section, a judgment circuit, a drive control circuit and a cooling fan. The judgment circuit determines a voltage applied to the cooling fan in accordance with the temperature detected by the temperature sensor and the required number of sheets to be copied supplied from the operating section to thereby drive the cooling fan appropriately.

Therefore, the cooling system requires only one temperature sensor so that cooling system can be assembled simple in control and structure and the manufacturing cost can be reduced accordingly.

What is claimed is:

1. A cooling system for an image forming machine, comprising:

means for cooling the inside of the image forming machine;

an operating section for inputting a signal representing a required number of sheets to be copied continuously;

means for detecting temperature inside of the image forming machine, said detecting means comprising a single temperature sensor;

means for determining a voltage value in accordance with an output signal of said operating section and an output signal of said temperature detecting means; and means for driving said cooling means in accordance with said voltage value determined by said voltage value determining means.

2. The cooling system of claim 1, wherein said voltage determining means determines a pseudo-number of sheets varied in accordance with said output signal of said temperature detecting means, a reference number of sheets by adding said required number of sheets supplied from said operating section to said pseudo-number of sheets, and said voltage value corresponding to said calculated reference number of sheets.

3. The cooling system of claim 2, wherein said pseudo-number of sheets is set to be 100 within a range between 30° C. and 35° C. of the temperature detected by said temperature detecting means, 150 within a range between 35° C. and 40° C., and 200 within a range between 40° C. and 45° C.

4. The cooling system of claim 2, wherein said voltage value is set to increase from 24 to 26 volt in proportion to the increase of said reference sheet number from 100 to 300, and said voltage value is constant outside said range.

5. The cooling system of claim 1, wherein said cooling means comprises a cooling fan.

6. The cooling system of claim 1, wherein said driving means comprises a plurality of resistors a resistant value of which being different from each other.

7. The cooling system of claim 1, wherein said temperature detecting means comprises a thermistor.

* * * * *